US008985757B2

(12) United States Patent
Liu et al.

(10) Patent No.: US 8,985,757 B2
(45) Date of Patent: Mar. 24, 2015

(54) SYSTEMS AND METHODS FOR INK-BASED DIGITAL PRINTING USING IMAGE OFFSET CONFIGURATION

(71) Applicant: Xerox Corporation, Norwalk, CT (US)

(72) Inventors: Chu-heng Liu, Penfield, NY (US); Jorge Alvarez, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/965,914

(22) Filed: Aug. 13, 2013

(65) Prior Publication Data

US 2015/0049153 A1 Feb. 19, 2015

(51) Int. Cl.
*B41J 2/01* (2006.01)
*B41J 2/47* (2006.01)

(52) U.S. Cl.
CPC ..... *B41J 2/47* (2013.01)
USPC ..... 347/102; 347/103

(58) Field of Classification Search
USPC ..... 347/224, 225, 6, 26, 93, 94, 100, 102, 347/103; 101/453–459, 465–467, 147, 101/450.1, 483
See application file for complete search history.

(56) References Cited

U.S. PATENT DOCUMENTS

| | | | | |
|---|---|---|---|---|
| 6,298,780 | B1 * | 10/2001 | Ben-Horin et al. | 101/478 |
| 2008/0202368 | A1 * | 8/2008 | Kajitani et al. | 101/350.1 |
| 2012/0103212 | A1 | 5/2012 | Stowe et al. | |
| 2012/0274914 | A1 * | 11/2012 | Stowe et al. | 355/53 |
| 2013/0104756 | A1 | 5/2013 | Stowe et al. | |

* cited by examiner

*Primary Examiner* — Hai C Pham
(74) *Attorney, Agent, or Firm* — Ronald E. Prass, Jr.; Prass LLP

(57) ABSTRACT

An ink-based digital printing system includes an imaging member having an imaging surface; a dampening fluid metering system, the dampening fluid metering system being configured to apply a layer of dampening fluid to the imaging surface; an inking system, the inking system being configured to apply radiation-curable ink to the imaging surface of the imaging member after the dampening fluid layer is patterned according to digital image data using a laser imaging system; and an offset member, the offset member forming a first ink transfer nip with the imaging member, the imaging member and the offset member being configured for transferring the ink image from the imaging surface to an offset member surface of the offset member.

18 Claims, 4 Drawing Sheets

SYSTEMS AND METHODS FOR INK-BASED DIGITAL PRINTING USING IMAGE OFFSET CONFIGURATION

FIELD OF DISCLOSURE

The disclosure relates to ink-based digital printing systems and methods. In particular, the disclosure relates to printing variable data using an ink-based digital printing system that includes an offset marking material transfer configuration.

BACKGROUND

Conventional lithographic printing techniques cannot accommodate true high-speed variable data printing processes in which images to be printed change from impression to impression, for example, as enabled by digital printing systems. The lithography process is often relied upon, however, because it provides very high quality printing due to the quality and color gamut of the inks used. Lithographic inks are also less expensive than other inks, toners, and many other types of printing or marking materials.

Ink-based digital printing uses a variable data lithography printing system, or digital offset printing system. A "variable data lithography system" is a system that is configured for lithographic printing using lithographic inks and based on digital image data, which may be variable from one image to the next. "Variable data lithography printing," or "digital ink-based printing," or "digital offset printing" is lithographic printing of variable image data for producing images on a substrate that are changeable with each subsequent rendering of an image on the substrate in an image forming process.

For example, a digital offset printing process may include transferring radiation-curable ink onto a portion of a fluorosilicone-containing imaging member surface that has been selectively coated with a dampening fluid layer according to variable image data. The ink is then cured and transferred from the printing plate to a substrate such as paper, plastic, or metal on which an image is being printed. The same portion of the imaging plate may be cleaned and used to make a succeeding image that is different than the preceding image, based on the variable image data. Ink-based digital printing systems are variable data lithography systems configured for digital lithographic printing that may include an imaging member having a reimageable surface layer, such as a silicone-containing surface layer.

Systems may include a dampening fluid metering system for applying dampening fluid to the reimageable surface layer, and an imaging system for laser-patterning the layer of dampening fluid according to image data. The dampening fluid layer is patterned by the imaging system to form a dampening fluid pattern on a surface of the imaging member based on variable data. The imaging member is then inked to form an ink image based on the dampening fluid pattern. The ink image may be partially cured, and is transferred to a printable medium, and the imaged surface of the imaging member from which the ink image is transferred is cleaned for forming a further image that may be different than the initial image, or based on different image data than the image data used to form the first image. Such systems are disclosed in U.S. patent application Ser. No. 13/095,714 ("714 Application"), titled "Variable Data Lithography System," filed on Apr. 27, 2011, by Stowe et al., which is commonly assigned, and the disclosure of which is hereby incorporated by reference herein in its entirety.

In related art offset printing, a combination of a permanently etched imaging plate and a blanket are used to reproduce static images. As discussed above, a digital or variable image print process includes patterning a printing with a fountain solution, developing with a lithographic-like ink, and almost completely transferred to printable media directly from the imaging member or printing plate. After the image is transferred, any small amount of ink on the printing plate gets cleaned and the plate is prepared for the next printing cycle as described before. The ink-based digital printing plate serves the functions of both an etched imaging plate and a blanket combination as in a related art lithographic print process. These combined functions place demanding and conflicting requirements on the ink-based digital printing plate.

SUMMARY

It has been found that related art offset approaches are not feasible because of reliance on the ink image splitting, resulting in the need for cleaning left over ink, less than optimal ink waste, and poor run cost for ink-based digital printing. Systems and methods are provided that include using a high-transfer-efficiency-offset architecture for use with lithographic inks in ink-based digital printing processes. In particular, rheological conditioning of the ink and careful tuning of ink-to-plate and ink-to-blanket adhesion enable multiple transfers at near 100% efficiency in system and methods of embodiments. In another embodiment, an offset color printing system configuration enables ink-based digital color printing at desirable run costs by using a plurality of ink-based digital printing modules having a high-transfer-efficiency-offset architecture to form a composite image on a substrate.

Exemplary embodiments are described herein. It is envisioned, however, that any system that incorporates features of systems described herein are encompassed by the scope and spirit of the exemplary embodiments.

DETAILED DESCRIPTION

Figure 1:
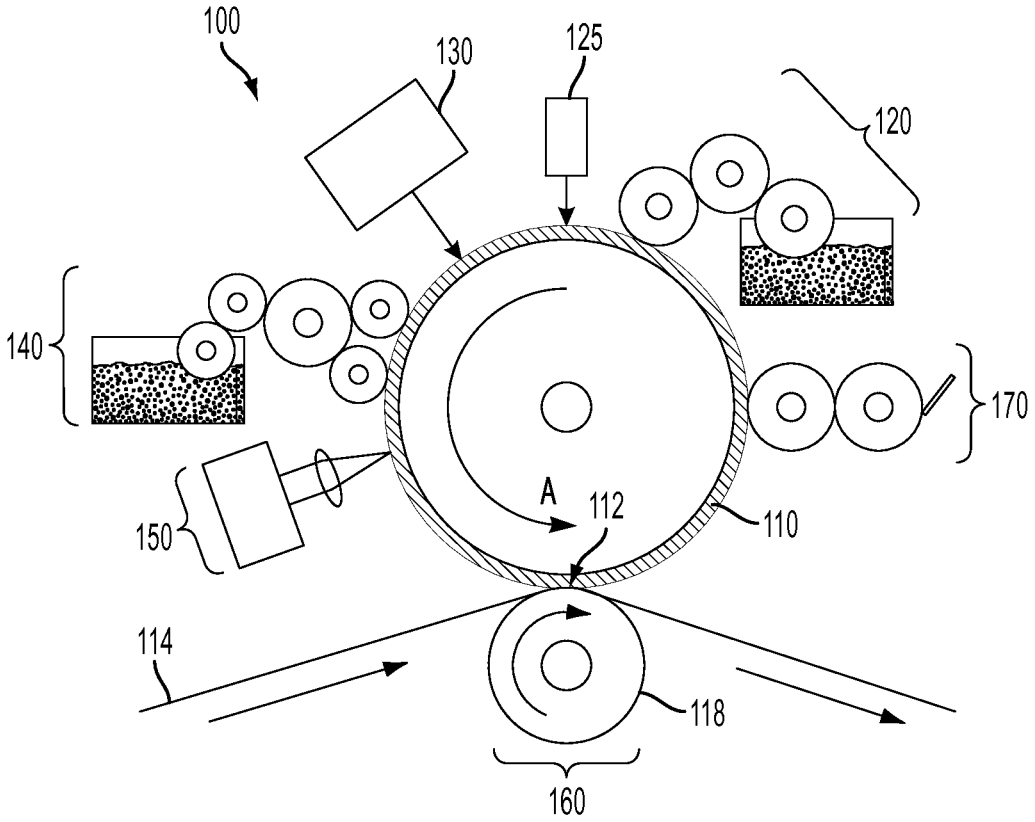
FIG. 1 RELATED ART
FIG. 1 shows a side diagrammatical view of a related art ink-based digital printing system.

Exemplary embodiments are intended to cover all alternatives, modifications, and equivalents as may be included within the spirit and scope of the apparatus and systems as described herein.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value.

Reference is made to the drawings to accommodate understanding of systems and methods for ink-based digital printing using an offset transfer configuration in accordance with embodiments. In the drawings, like reference numerals are used throughout to designate similar or identical elements.

The drawings depict various embodiments of illustrative systems for ink-based digital printing using an offset printing configuration.

The 714 Application describes an exemplary related art variable data lithography system 100 for ink-based digital printing, such as that shown, for example, in FIG. 1. A general description of the exemplary system 100 shown in FIG. 1 is provided here. Additional details regarding individual components and/or subsystems shown in the exemplary system 100 of FIG. 1 may be found in the 714 Application.

As shown in FIG. 1, the exemplary system 100 may include an imaging member 110. The imaging member 110 in the embodiment shown in FIG. 1 is a drum, but this exemplary depiction should not be interpreted so as to exclude embodiments wherein the imaging member 110 includes a drum, plate or a belt, or another now known or later developed configuration. The reimageable surface may be formed of materials including, for example, a class of materials commonly referred to as silicones, including polydimethylsiloxane (PDMS), among others. The reimageable surface may be formed of a relatively thin layer over a mounting layer, a thickness of the relatively thin layer being selected to balance printing or marking performance, durability and manufacturability.

The imaging member 110 is used to apply an ink image to an image receiving media substrate 114 at a transfer nip 112. The transfer nip 112 is formed by an impression roller 118, as part of an image transfer mechanism 160, exerting pressure in the direction of the imaging member 110. Image receiving medium substrate 114 should not be considered to be limited to any particular composition such as, for example, paper, plastic, or composite sheet film. The exemplary system 100 may be used for producing images on a wide variety of image receiving media substrates. The 714 Application also explains the wide latitude of marking (printing) materials that may be used, including marking materials with pigment densities greater than 10% by weight. As does the 714 Application, this disclosure will use the term ink to refer to a broad range of printing or marking materials to include those which are commonly understood to be inks, pigments, and other materials which may be applied by the exemplary system 100 to produce an output image on the image receiving media substrate 114.

The 714 Application depicts and describes details of the imaging member 110 including the imaging member 110 being comprised of a reimageable surface layer formed over a structural mounting layer that may be, for example, a cylindrical core, or one or more structural layers over a cylindrical core.

The exemplary system 100 includes a dampening fluid system 120 generally comprising a series of rollers, which may be considered as dampening rollers or a dampening unit, for uniformly wetting the reimageable surface of the imaging member 110 with dampening fluid. A purpose of the dampening fluid system 120 is to deliver a layer of dampening fluid, generally having a uniform and controlled thickness, to the reimageable surface of the imaging member 110. As indicated above, it is known that a dampening fluid such as fountain solution may comprise mainly water optionally with small amounts of isopropyl alcohol or ethanol added to reduce surface tension as well as to lower evaporation energy necessary to support subsequent laser patterning, as will be described in greater detail below. Small amounts of certain surfactants may be added to the fountain solution as well. Alternatively, other suitable dampening fluids may be used to enhance the performance of ink based digital lithography systems. Exemplary dampening fluids include water, NOVEC 7600 (1,1,1,2,3,3-Hexafluoro-4-(1,1,2,3,3,3-hexafluoropropoxyl)pentane and has CAS#870778-34-0.), and D4 (octamethylcyclotetrasiloxane). Other suitable dampening fluids are disclosed, by way of example, in co-pending U.S. patent application Ser. No. 13/284,114, titled "Dampening Fluid For Digital Lithographic Printing," filed on Oct. 28, 2011, by Stowe, the disclosure of which is hereby incorporated herein by reference in its entirety.

Once the dampening fluid is metered onto the reimageable surface of the imaging member 110, a thickness of the dampening fluid may be measured using a sensor 125 that may provide feedback to control the metering of the dampening fluid onto the reimageable surface of the imaging member 110 by the dampening fluid system 120.

After a precise and uniform amount of dampening fluid is provided by the dampening fluid system 120 on the reimageable surface of the imaging member 110, and optical patterning subsystem 130 may be used to selectively form a latent image in the uniform dampening fluid layer by image-wise patterning the dampening fluid layer using, for example, laser energy. Typically, the dampening fluid will not absorb the optical energy (IR or visible) efficiently. The reimageable surface of the imaging member 110 should ideally absorb most of the laser energy (visible or invisible such as IR) emitted from the optical patterning subsystem 130 close to the surface to minimize energy wasted in heating the dampening fluid and to minimize lateral spreading of heat in order to maintain a high spatial resolution capability. Alternatively, an appropriate radiation sensitive component may be added to the dampening fluid to aid in the absorption of the incident radiant laser energy. While the optical patterning subsystem 130 is described above as being a laser emitter, it should be understood that a variety of different systems may be used to deliver the optical energy to pattern the dampening fluid.

The mechanics at work in the patterning process undertaken by the optical patterning subsystem 130 of the exemplary system 100 are described in detail with reference to FIG. 5 in the 714 Application. Briefly, the application of optical patterning energy from the optical patterning subsystem 130 results in selective removal of portions of the layer of dampening fluid.

Following patterning of the dampening fluid layer by the optical patterning subsystem 130, the patterned layer over the reimageable surface of the imaging member 110 is presented to an inker subsystem 140. The inker subsystem 140 is used to apply a uniform layer of ink over the layer of dampening fluid and the reimageable surface layer of the imaging member 110. The inker subsystem 140 may use an anilox roller to meter an offset lithographic ink onto one or more ink forming rollers that are in contact with the reimageable surface layer of the imaging member 110. Separately, the inker subsystem 140 may include other traditional elements such as a series of metering rollers to provide a precise feed rate of ink to the reimageable surface. The inker subsystem 140 may deposit the ink to the pockets representing the imaged portions of the reimageable surface, while ink on the unformatted portions of the dampening fluid will not adhere to those portions.

The cohesiveness and viscosity of the ink residing in the reimageable layer of the imaging member 110 may be modified by a number of mechanisms. One such mechanism may involve the use of a rheology (complex viscoelastic modulus) control subsystem 150. The rheology control system 150 may form a partial crosslinking core of the ink on the reimageable surface to, for example, increase ink cohesive strength relative to the reimageable surface layer. Curing mechanisms may include optical or photo curing, heat curing, drying, or various forms of chemical curing. Cooling may be used to modify rheology as well via multiple physical cooling mechanisms, as well as via chemical cooling.

The ink is then transferred from the reimageable surface of the imaging member 110 to a substrate of image receiving medium 114 using a transfer subsystem 160. The transfer occurs as the substrate 114 is passed through a nip 112 between the imaging member 110 and an impression roller 118 such that the ink within the voids of the reimageable surface of the imaging member 110 is brought into physical contact with the substrate 114. With the adhesion of the ink having been modified by the rheology control system 150, modified adhesion of the ink causes the ink to adhere to the substrate 114 and to separate from the reimageable surface of the imaging member 110. Careful control of the temperature and pressure conditions at the transfer nip 112 may allow transfer efficiencies for the ink from the reimageable surface of the imaging member 110 to the substrate 114 to exceed 95%. While it is possible that some dampening fluid may also wet substrate 114, the volume of such a dampening fluid will be minimal, and will rapidly evaporate or be absorbed by the substrate 114.

Following the transfer of the majority of the ink to the substrate 114, any residual ink and/or residual dampening fluid must be removed from the reimageable surface of the imaging member 110, preferably without scraping or wearing that surface. An air knife may be employed to remove residual dampening fluid. It is anticipated, however, that some amount of ink residue may remain. Removal of such remaining ink residue may be accomplished through use of some form of cleaning subsystem 170. The 714 Application describes details of such a cleaning subsystem 170 including at least a first cleaning member such as a sticky or tacky member in physical contact with the reimageable surface of the imaging member 110, the sticky or tacky member removing residual ink and any remaining small amounts of surfactant compounds from the dampening fluid of the reimageable surface of the imaging member 110. The sticky or tacky member may then be brought into contact with a smooth roller to which residual ink may be transferred from the sticky or tacky member, the ink being subsequently stripped from the smooth roller by, for example, a doctor blade.

The 714 Application details other mechanisms by which cleaning of the reimageable surface of the imaging member 110 may be facilitated. Regardless of the cleaning mechanism, however, cleaning of the residual ink and dampening fluid from the reimageable surface of the imaging member 110 is essential to preventing ghosting in the proposed system. Once cleaned, the reimageable surface of the imaging member 110 is again presented to the dampening fluid system 120 by which a fresh layer of dampening fluid is supplied to the reimageable surface of the imaging member 110, and the process is repeated.

In related art systems such as those shown in FIG. 1, the surface of the imaging member must enable all functions related to imaging, inking, and transfer to substrate. Because ink-based digital printing imaging member surface serves the functions of an offset transfer blanket, the related art imaging surface must be fairly conformable; able to withstand substantial pressure at a transfer nip; able to withstand mechanical wear from repetitive contact with the printable substrate; and able to withstand constant contact with various substrates that can cause chemical contaminations and surface energy change.

Systems in accordance with embodiments address these requirements while permitting wider design latitude by partitioning plate functionalities across two distinct physical members: the imaging member and the offset member, instead using a single imaging member or printing plate. In related art lithographic printing, the ink image splits at a transfer efficiency of about 50% at both the plate-to-offset blanket interface, and the blanket-to-substrate interface. This transfer efficiency is undesirable for ink-based digital printing at least because cleaning and reconditioning systems will be affected, waste production will be less than optimal, and run performance will be more costly than desired. Therefore, a high transfer efficiency is required at both transfer interface points, or both ink transfer nips. In particular, systems in accordance with embodiments a are configured to enable an offset blanket to receive an offset ink image from one surface, and release the image onto another surface with high transfer efficiency.

Image transfer in the digital lithographic ink printing process relies on a balance of adhesion and cohesion. In systems in accordance with embodiments, materials must be selected to satisfy conditions wherein adhesion of ink to an ink releasing surface is less than cohesion of the ink. Also, the adhesion to the ink releasing surface must be less than adhesion to an ink receiving surface. Cohesion of the ink layer increases with the viscosity of the ink, and decreases rapidly with the ink layer thickness. Ideally, 100% transfer efficiency is achieved when the ink completely adheres to the offset blank after being developed on the imaging member and subsequent completely adheres to the printable substrate.

A material that forms the surface of the offset member or offset blanket, for example, must be carefully chosen. In particular, the material must be configured for enabling full release of the ink at final transfer. The materials may be selected from the group of materials comprising silicones, fluoro-silicones, and fluorelastomers such as suitable VITON rubber(s). Moreover, the ink-offset member adhesion should be carefully adjusted to satisfy the following two conditions: 1) adhesion of ink to an ink releasing surface must be less than cohesion of the ink; and 2) the adhesion to the ink releasing surface must be less than adhesion to an ink receiving surface.

To achieve the first requirement based on available material sets, a surface roughness of the imaging member and/or offset member may be modified. For example, similar surface materials may be used for both the imaging member and the offset member. The surface of the imaging member may have a smooth finish, while the offset member may have a rougher finish. Desired image quality may be achieved using a smooth imaging member plate with vaporized dampening fluid, for example. Excellent ink release has been achieved using systems wherein the offset blanket has a rougher surface than the imaging plate surface.

The second requirement may be achieved by using a rheological conditioning system configured to expose ink on the offset member to radiation such as UV radiation. The conditioning may include any exposure that improves ink layer cohesion of the ink layer disposed on the offset member. For example, rheological conditioning may include UV pre-curing, evaporation, heating, etc.

Figure 2:
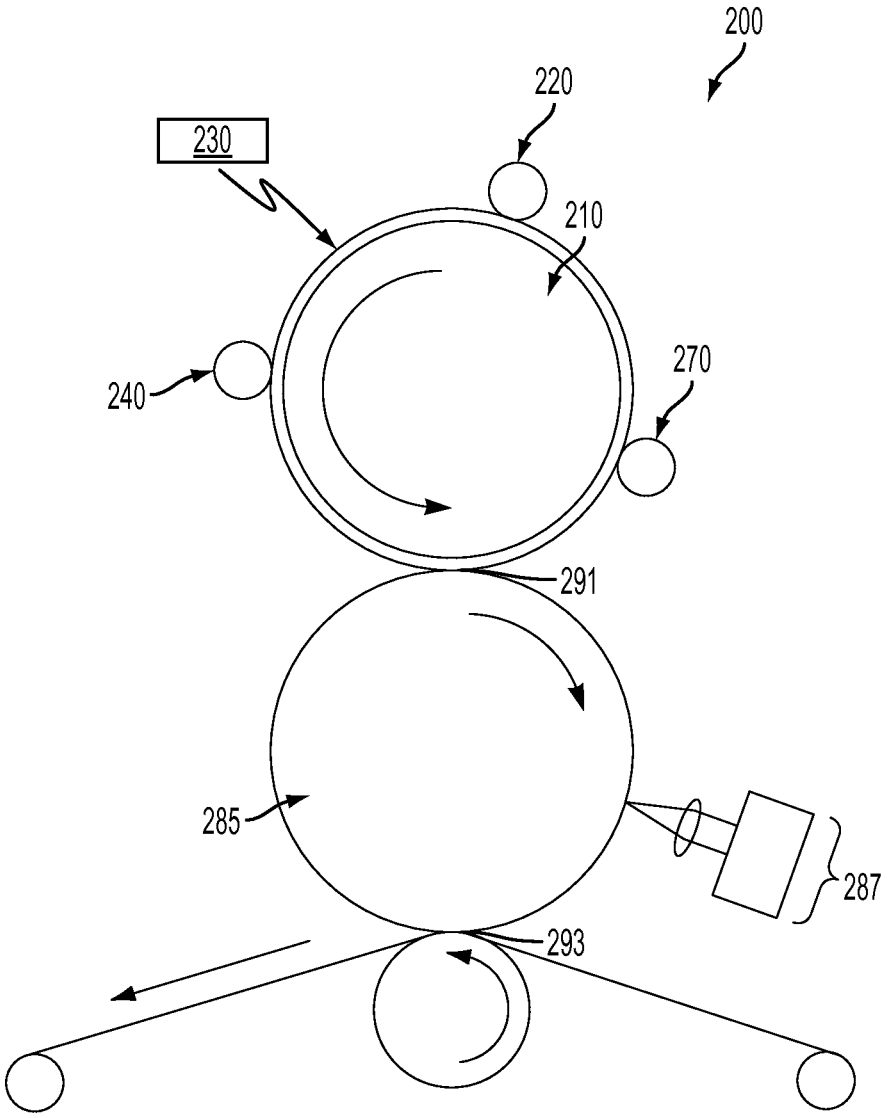
FIG. 2 shows a diagrammatical side view of an ink-based digital printing system including an offset transfer configuration in accordance with an exemplary embodiment.

An ink-based digital printing system including an offset transfer configuration in accordance with an embodiment is shown in FIG. 2. In particular, FIG. 2 an ink-based digital printing system 200 having an imaging member 210. The printing system 200 may include a dampening fluid metering system 220 that is configured to apply a thin, uniform layer of dampening fluid onto a surface of the imaging member 210. The system 200 may include a dampening fluid patterning system 230, which may comprise a laser imaging system configured to selectively expose portions of the dampening fluid layer to laser irradiation. The laser imaging system may comprise a UV laser or laser array, for example. The selective exposure according to digital image data may produce a dampening fluid pattern on the imaging member surface.

The system 200 may include an inking system 240 for applying ink to the surface of the imaging member 210 after the dampening fluid pattern is formed on the surface thereof. For example, the inking system 240 may comprise an anilox roll ink transfer system. As the ink is transferred to the surface of the imaging member 210, the ink adheres to select portions of the imaging member surface based on the dampening fluid pattern formed thereon to form an ink image. The ink image may be contact-transferred at a first transfer nip to a second roll before being transferred and fixed onto a printable substrate such as paper. FIG. 2 shows the system 200 having a cleaning system 270 disposed adjacent to the imaging member 210 for removing excess material from the imaging member surface after an ink image has been transferred therefrom during an ink-based digital printing process.

In particular, FIG. 2 shows an offset member 285 having an offset blanket disposed thereon. The offset member 285 may be configured to be exposed to treatment from an offset member rheological conditioning system 287. The rheological conditioning system 287 may be a laser configured for curing or partial curing of ink transferred to the offset member 285 from the imaging member 210. The rheological conditioning system 287 may be configured to expose an ink image carried on the surface of the offset member 285 to UV light for partially curing or curing the ink image. For example, the conditioning system 287 may comprise one or more lamps configured to emit UV light suitable for curing the ink transferred to the offset member 285.

The imaging member 210 and the offset member 285 form the first ink transfer nip 291 at which ink is contact-transferred to the offset member 285 after ink image formation on the imaging member 210. After the ink image is transferred to the surface of the offset member 285, and optionally cured or partially cured using the conditioning system 287, the ink may be transferred at a second ink transfer nip 293 to a printable substrate, such as paper or other printable media.

The system 200 must be configured so that the ink-offset member adhesion satisfies the following two conditions: 1) adhesion of ink to an ink releasing surface must be less than cohesion of the ink; and 2) the adhesion to the ink releasing surface must be less than adhesion to an ink receiving surface.

To achieve the first requirement based on available material sets, a surface roughness of the imaging member 210 and/or offset member 285 may be modified. For example, similar surface materials may be used for both the imaging member and the offset member. Exemplary surface materials may include silicone, fluorosilicone, and fluoroelastomers such as VITON rubber materials. The surface of the imaging member may have a smooth finish, while the offset member may have a rougher finish than the imaging member surface. Desirable image quality may be achieved using a smooth imaging member plate and vaporized dampening fluid, for example. Excellent ink release has been achieved using systems wherein the offset blanket has a rougher surface than the imaging plate surface.

The second requirement may be achieved by using a rheological conditioning system configured to expose ink on the offset member to radiation such as UV radiation. The conditioning may include any exposure that improves ink layer cohesion of the ink layer disposed on the offset member. For example, rheological conditioning may include UV pre-curing, evaporation, heating, etc.

Figure 3:
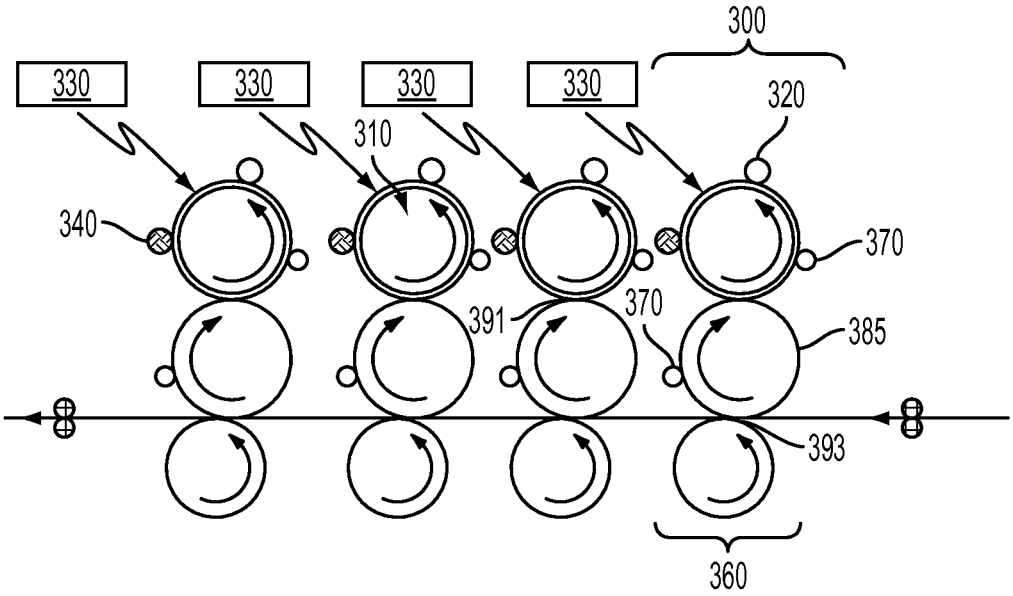
FIG. 3 shows a diagrammatical cross-sectional view of an ink-based digital printing system including an offset transfer color printing configuration in accordance with exemplary embodiments.

FIG. 3 shows a diagrammatical cross-sectional view of an ink-based digital printing system including a plurality of offset transfer architecture printing modules 300 in accordance with exemplary embodiments. In particular, FIG. 3 shows a ink-based digital printing system having a plurality of ink-based digital printing modules 300. Each of the modules 300 may be configured for printing a different color ink, for example, Yellow, Magenta, Cyan, and Black.

Each module 300 includes an imaging member 310 on which dampening fluid from a dampening fluid metering system 320 may deposited to form a thin, uniform layer of dampening fluid. The dampening fluid may be patterned by exposure to laser treatment according to digital image data to form a patterned dampening fluid layer on the surface of the imaging member 310. In particular, each module 300 may include a laser imaging system or dampening fluid patterning system 330 that is configured to expose an applied dampening fluid layer on the surface of the imaging member 310 to laser radiation for selectively removing portions of the dampening fluid layer according to digital image data.

The patterned dampening fluid layer may inked by an inking system 340 to form an ink image. In an embodiment, the inking system 340 may comprise an anilox roll ink delivery system. After the ink image ink image is transferred from the imaging member 310, the surface of the imaging member 310 may be cleaned using a cleaning system 370. The ink image is transferred from the imaging member 310 to an offset member, and subsequently to printable substrate carried through substrate supply path 360.

In particular, the imaging member 310 forms a first transfer nip 391 with the offset member 385. The developed ink image may be contact-transferred from the imaging member 310 to the offset member 385 at the first transfer nip 391. The transferred ink image may be subsequently transferred from the offset member 385 to a printable substrate at the second transfer nip 393. The transfer efficiency at both the first transfer nip 391 and the second transfer nip 393 may preferably be at or near 100%. Systems may include a plurality of modules 300.

Each of the modules 300 may be optionally configured to print using a different color ink. For example, the modules may be configured to produce a print according to digital image data wherein a composite color image is formed using the different color inks of at least two of the plurality of modules.

Each of the modules 300 must be configured so that the ink-offset member adhesion satisfies the following two conditions: 1) adhesion of ink to an ink releasing surface must be less than cohesion of the ink; and 2) the adhesion to the ink releasing surface must be less than adhesion to an ink receiving surface.

To achieve the first requirement based on available material sets, a surface roughness of the imaging member 310 and/or offset member 385 may be modified. For example, similar surface materials may be used for both the imaging member and the offset member. Exemplary surface materials may include silicone, fluorosilicone, and fluoroelastomers such as VITON rubber materials. The surface of the imaging member may have a smooth finish, while the offset member may have a rougher finish than the imaging member surface. Desirable image quality may be achieved using a smooth imaging member plate and vaporized dampening fluid, for example. Excellent ink release has been achieved using systems wherein the offset blanket has a rougher surface than the imaging plate surface.

The second requirement may be achieved by using a rheological conditioning system configured to expose ink on the offset member to radiation such as UV radiation. The conditioning may include any exposure that improves ink layer cohesion of the ink layer disposed on the offset member. For example, rheological conditioning may include UV pre-curing, evaporation, heating, etc.

EXAMPLE

An ink-based digital printing system in accordance with embodiments was reduced to practice. In particular, the system includes an imaging member having a surface comprising a smooth fluorosilicone material, flow-coated NUSIL. The offset member surface is a textured fluorsilicone surface comprising NUSIL and a surface roughness texture similar to that of a traditional lithographic plate. An ink suitable for ink-based digital printing was applied to the plate with an ink delivery that includes an anilox roll. It was found that the ink was contact-transferred from the imaging member to the offset member with about 100% efficiency. A second ink transfer, from the offset member to a printable substrate, LUSTROGLOSS paper, was also accomplished with a transfer efficiency of greater than 90%. Other suitable materials for use as an imaging member or offset member surface include fluoroelastomers such as VITON, fluorosilicone and silicone.

Methods in accordance with embodiments may include printing a single ink image with an ink-based digital printing system or module having an offset configuration as shown in FIG. 2. Methods in accordance with embodiments may include printing a composite ink image using a plurality of ink-based digital printing modules that are arranged for sequentially fixing ink images onto a printable substrate such as paper, such as the system shown in FIG. 3.

Figure 4:
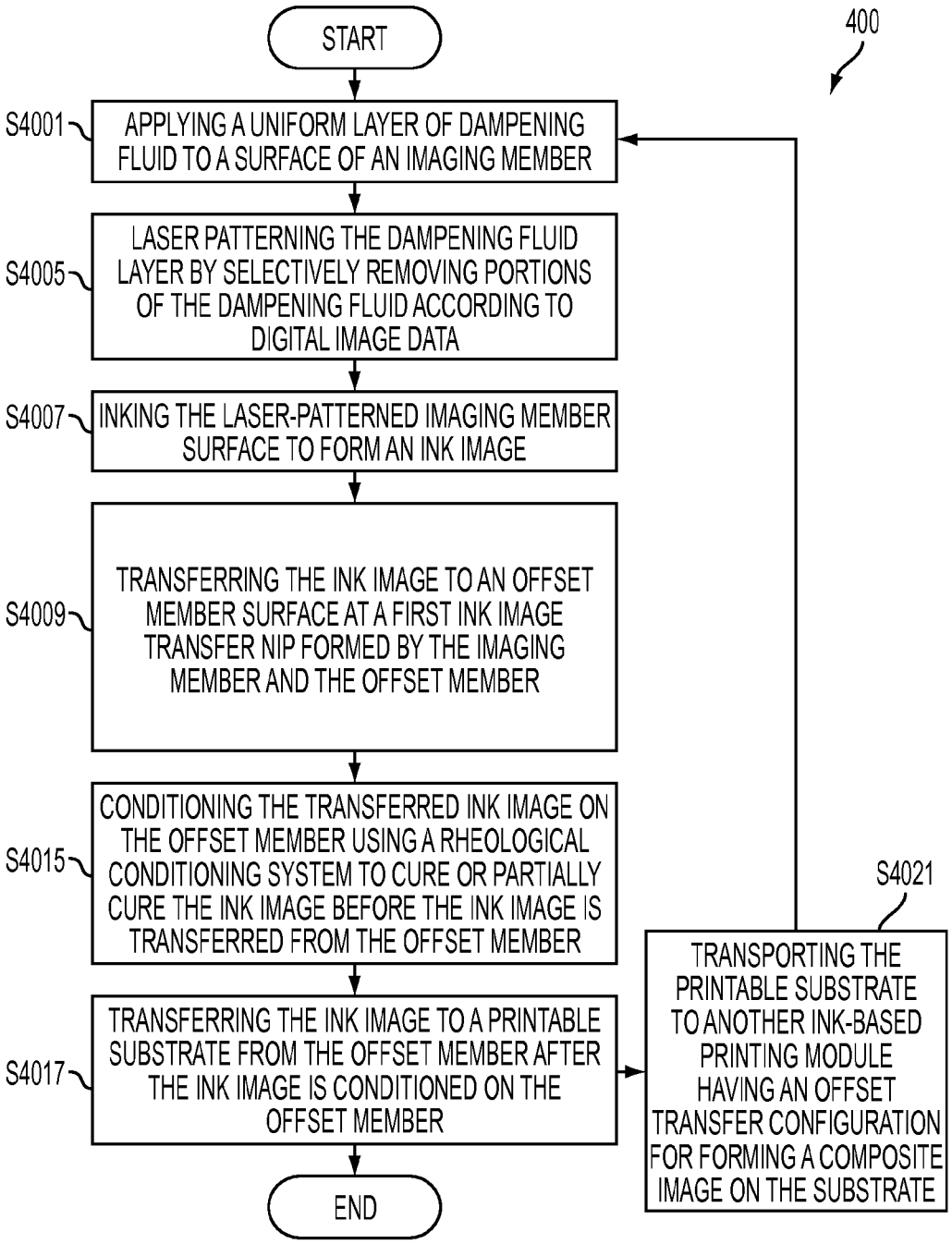
FIG. 4 shows methods for offset ink-based digital printing in accordance with an exemplary embodiment.

In particular, FIG. 4 shows methods 400 for ink-based digital printing using a system having an offset configuration. For example, methods may include applying a uniform layer of dampening fluid onto an imaging member to form a layer of about 1 micron or less in thickness at S4001. The imaging member surface may be formed of, for example, silicone, fluorosilicone, and/or fluoroelastomer components. The imaging member surface may have a smooth texture.

Methods may include laser patterning the dampening fluid at S4005. The laser patterning includes selectively exposing portions of the dampening fluid layer to radiation to remove the exposed portions, resulting in a pattern. The laser patterning is operated in accordance with digital image data that informs the pattern to be formed by selective evaporation or removal of dampening fluid.

The laser-patterned dampening fluid layer may be inked by an inking member at S4007. For example, an anilox-roll based ink delivery system may be used to meter ink onto the laser-patterned imaging member surface to form an ink image thereon. The ink image may be transferred to an offset member or offset blanket at S4009. The offset member may preferably have a surface texture that is rougher than a surface texture of the imaging member. Further, the offset member may be formed of material selected from silicone, fluorosilicone, and/or fluoroelastomer. The offset member and the imaging member are configured to form a first transfer nip at which the ink is transferred with at or near 100% efficiency.

A rheological conditioning system may be disposed adjacent to the offset member. At S4015, the ink image transferred to the offset member surface may be conditioned to cure or partially cure the ink of the ink image thereby adjusting cohesion characteristics of the ink. Conditioning may be carried out by curing, drying, and/or heating. Accordingly, the ink may be transferred at a second transferred nip at a transfer efficiency at or near 100%, which may be ensured by optionally conditioning the ink as shown at S4015.

The ink image may then be transferred at a second ink transfer nip at S4017. The second ink transfer nip may be formed by the offset member and a printable substrate such as a paper. The ink may be substantially completely transferred from the surface of the offset member onto a surface of the substrate. In an embodiment, the printing process may end after S4017. In another embodiment, the printing process may continue for forming a composite ink image. For example, an offset configuration ink-based digital printing system may be used wherein an ink image is printed on a substrate using a first printing module of a plurality of printing modules. The modules may be arranged for printing a composite image on a printable substrate that is transported from module to module as in the system shown by way of example in FIG. 3.

For example, methods may include performing S4001, S4005, S4007, S4009, optionally S4015, and S4017 to form an ink image on a printable substrate using a first ink-based digital printing module having an offset configuration. Methods may further include transporting the substrate having the printed image to a second ink-based digital printing module for printing a ink image on the substrate at S4021. The process may be repeated at subsequent modules as necessary to form a desired composite image. By way of example, each module may be configured for printing with particular color ink.

It will be appreciated that the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. An ink-based digital printing system including an imaging member having a reimageable imaging surface, a dampening fluid metering system, the dampening fluid metering system being configured to apply a layer of dampening fluid to the imaging surface, and an inking system, the inking system being configured to apply ink to the imaging surface of the imaging member after the dampening fluid layer is patterned according to digital image data using a laser imaging system, the system comprising:

an offset member, the offset member forming a first ink transfer nip with the imaging member, the imaging member and the offset member being configured for transferring the ink image from the imaging surface to an offset member surface of the offset member; and a rheological conditioning system, the rheological conditioning system being configured to irradiate ink disposed on the offset member before the ink is transferred from the offset member.

2. The system of claim 1, wherein the imaging member surface comprises a smooth texture.

3. The system of claim 1, wherein the offset member surface comprises a rougher texture than the texture of the imaging member surface.

4. The system of claim 1, wherein an adhesion of the ink to the imaging member is less than a cohesion of the ink.

5. The system of claim 1, wherein an adhesion of the ink to the imaging member is less than an adhesion of the ink to the offset member surface.

6. The system of claim 1, wherein the imaging surface comprises silicone.

7. The system of claim 1, wherein the imaging surface comprises fluorosilicone.

8. The system of claim 1, wherein the imaging surface comprises a fluoroelastomer material.

9. An ink-based digital printing system for printing a composite ink image according to digital image data, the system having a plurality of ink-based digital printing modules, each of the plurality of ink-based digital printing modules having a dampening fluid metering system, the dampening fluid metering system being configured to apply a layer of dampening fluid to the imaging surface, and an inking system, the inking system being configured to apply ink to the imaging surface of the imaging member after the dampening fluid layer is patterned according to digital image data using a laser imaging system, the ink-based digital printing system comprising:

at least one of the plurality of ink-based digital printing modules having an offset member, the offset member forming a first ink transfer nip with the imaging member, the imaging member and the offset member being configured for transferring the ink image from the imaging surface to an offset member surface of the offset member;

a rheological conditioning system, the rheological conditioning system being configured to irradiate ink disposed on the offset member before the ink is transferred from the offset member.

10. The system of claim 9, wherein the imaging member surface comprises a smooth texture.

11. The system of claim 9, wherein the offset member surface comprises a rougher texture than the texture of the imaging member surface.

12. The system of claim 9, wherein an adhesion of the ink to the imaging member is less than a cohesion of the ink.

13. The system of claim 9, wherein an adhesion of the ink to the imaging member is less than an adhesion of the ink to the offset member surface.

14. The system of claim 9, wherein the imaging surface comprises silicone.

15. The system of claim 9 wherein the imaging surface comprises fluorosilicone.

16. The system of claim 9, wherein the imaging surface comprises a fluoroelastomer material.

17. A method for ink-based digital printing, comprising:

forming an ink image on a surface of an imaging member by selectively removing portions a dampening fluid layer disposed on the imaging member surface according to digital image data to form a patterned dampening fluid layer, and inking the imaging member surface having the patterned dampening fluid layer to form an ink image on the imaging member surface, the imaging member surface forming a first ink transfer nip with an offset member surface, the offset member surface having a surface texture that is rougher than a surface texture of the imaging member surface;

transferring the ink image from the imaging member to the offset member at the first transfer nip, wherein ink disposed on the offset member is irradiated by a rheological conditioning system before the ink is transferred from the offset member;

exposing the transferred ink image to radiation to at least partially cure or dry the ink image; and transferring the ink image from the offset member to a printable substrate at a second ink transfer nip, the second ink transfer nip being formed by the offset member and the substrate.

18. The method of claim 17, comprising:

transporting the substrate having the printed ink image to another ink-based digital printing system having an offset configuration for printing a second ink image on the substrate to form a composite image with the first ink image.

* * * * *